United States Patent [19]

Potthoff

[11] 4,127,238

[45] Nov. 28, 1978

[54] TOROIDAL CORE WINDER

[75] Inventor: Clifford M. Potthoff, Livermore, Calif.

[73] Assignee: The United States of America as represented by the United States Department of Energy, Washington, D.C.

[21] Appl. No.: 804,127

[22] Filed: Jun. 6, 1977

[51] Int. Cl.[2] ..... B65H 81/02

[52] U.S. Cl. ..... 242/4 A; 242/4 C

[58] Field of Search ..... 242/4 A, 4 B, 4 R, 4 C; 29/605; 156/422

[56] References Cited

U.S. PATENT DOCUMENTS

| | | | |
|---|---|---|---|
| 841,305 | 1/1907 | Atwood | 242/4 B |
| 2,905,399 | 9/1959 | Baker | 242/4 A |
| 3,000,580 | 9/1961 | Matovich, Jr. | 242/4 A |
| 3,132,816 | 5/1964 | Oshima | 242/4 B |
| 3,307,991 | 3/1967 | Fahrbach | 242/4 B |
| 3,451,631 | 6/1969 | Tillman | 242/4 A |
| 3,811,629 | 5/1974 | Sedgewick | 242/4 A |

FOREIGN PATENT DOCUMENTS

| | | | |
|---|---|---|---|
| 523,338 | 7/1940 | United Kingdom | 242/4 A |

*Primary Examiner*—Billy S. Taylor

*Attorney, Agent, or Firm*—Dean E. Carlson; Dudley W. King; Robert Southworth, III

[57] ABSTRACT

The disclosure is directed to an apparatus for placing wire windings on a toroidal body, such as a transformer core, having an orifice in its center. The apparatus comprises a wire storage spool, a wire loop holding continuous belt maintained in a C-shaped loop by a belt supporting structure and provision for turning the belt to place and tighten loops of wire on a toroidal body, which is disposed within the gap of the C-shaped belt loop.

5 Claims, 3 Drawing Figures

TOROIDAL CORE WINDER

FIELD OF THE INVENTION

The invention relates to winding mechanisms and more particularly to devices for winding wire or other similar material on toroidal bodies containing orifices such as transformer cores.

BACKGROUND OF THE INVENTION

In winding cores with wire most prior art core winding devices require the use of a bobbin which, for each loop wound, must be passed through the opening in the core to be wound. This limits the number of turns that may be wound on a core to the number that will leave an orifice sufficiently large to allow the bobbin to be passed through the center of the wire wound core at completion. Using a bobbin then, an orifice below a size large enough for bobbin passage can not be exceeded. It is frequently desirable to leave a very small orifice or even completely fill the core opening with winding turns to maximize efficiency and minimize overall size of the transformer. A maximum number of windings provides maximum inductance for a given size core. Too, maximum wire size for a given number of turns will increase current carrying capacity.

It is one object of the present invention to eliminate the need for a bobbin while winding wire on a core.

It is another object of this invention to provide a capability for winding a core until a very small opening is left or even until the core is completely filled with wire windings.

One advantage of the present invention is that the clearance requirement for bobbins normally employed by conventional core winders is eliminated.

Another advantage of the instant invention is that in accordance therewith a core may be completely filled with winding turns to achieve maximally efficient device.

SUMMARY OF THE INVENTION

In accordance with the present invention there is provided an apparatus adapted for placing wire windings on a toroidal body such as a core having an orifice. The apparatus comprises provision for storing a supply of wire, a belt in a C-shaped loop maintained in such position and moved therein by a hand or machine controllable element. The core or other toroidal body to have wire, string or the like wound on it is disposed within the gap in the C-shaped belt loop. Wire is wound about the periphery of the C-shaped loop and through the orifice in the toroidal body in a number of loops sufficient to contain the total wire needed to provide the desired number of loops to be wound about said body. As the belt is moved to tighten the loops about the body one at a time, wire is slipped in a controllable fashion one loop at a time from the C-shaped belt loop and each such wire loop is secured on the body.

BRIEF DESCRIPTION OF THE DRAWINGS

Other objects and advantages of the present invention will be apparent to those skilled in the art from the following description with reference to the appended drawings wherein like numbers denote like parts and wherein.

DETAILED DESCRIPTION OF A PREFERRED EMBODIMENT OF THE INVENTION

Figure 1:
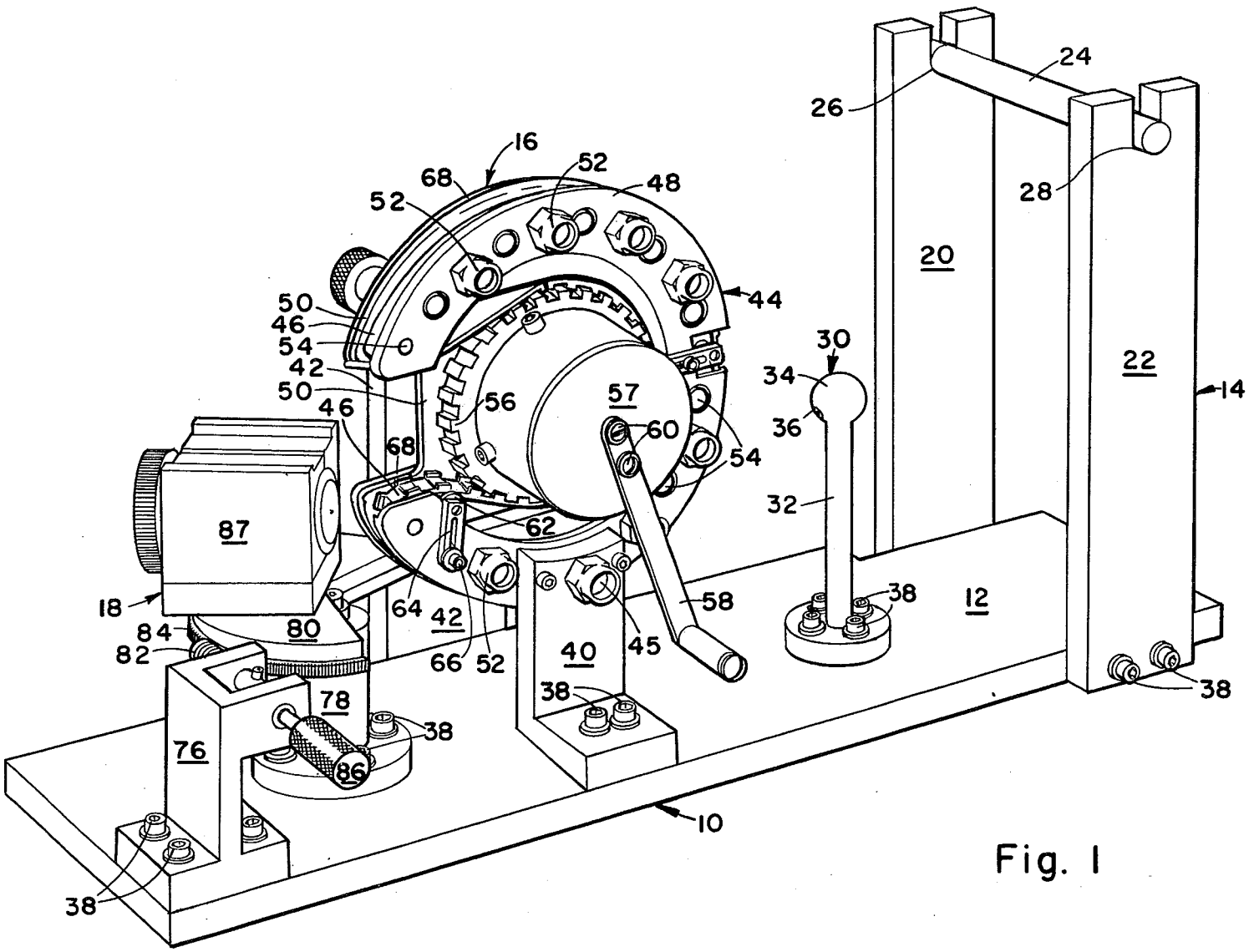
FIG. 1 is a perspective view of a preferred embodiment of the invention.

Reference is now made to FIG. 1 which shows an apparatus in accordance with the invention 10 hereinafter referred to as a core winder having a base 12, a wire storage rack 14, a wire winder 16 and a core support 18. The wire storage rack comprises two upright posts 20 and 22, affixed to base 12, which support an axle 24 supported by two U-shaped bearings 26 and 28 upon which, for example, a spool of wire may be mounted.

Disposed between the wire storage rack and the wire winder is a wire guide 30 comprising an upright 32 having a head 34 in which an orifice containing bearing 36 is disposed. Bearing 36 may comprise, for example, a cylindrical tubular polytetrafluoroethylene element which supplies a relatively frictionless path for the wire from a spool mounted on axle 24 to pass through. Bearing 36 is seen in a cutaway view in FIG. 2. Uprights 20 and 22 and wire guide 30 may all be fastened to base 12 with, for example, bolts 38.

Figure 3:
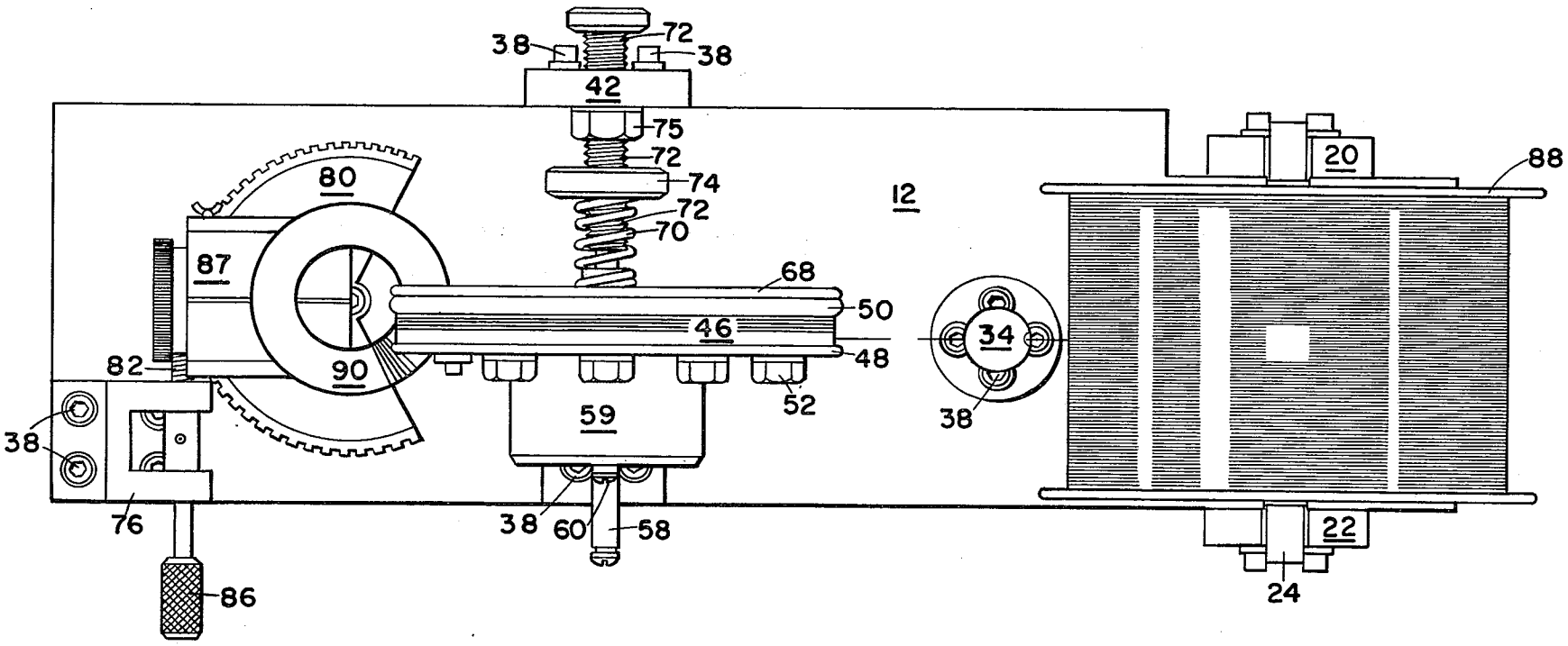
FIG. 3 is a top view of the FIGS. 1 and 2 apparatus.

Wire winder 16 is supported by a short upright leg 40 and a long upright leg 42. A C-shaped belt support member 44 is affixed to short leg 40 by a bolt 45 and supports thereon a belt 46 in a C-shaped loop. The member 44 comprises a C-shaped side 48 having an open orifice and a filled-in C-shaped side 50 which are bolted together by bolts 52. Sides 48 and 50 support in a C-shaped configuration bearings 54 over which the outer periphery of belt 46 moves. The inner periphery of belt 46 is maintained in frictional engagement with a drive gear 56 and drum 59 which may be turned by, for example, a handle 58 mounted on drum 59 by screws 60. When the handle 58 is turned, gear 56 frictionally engages and thereby drives the inner periphery of belt loop 46, the outer periphery of the belt loop being supported by and movable on the bearings 54 disposed on the C-shaped structure. The tension of the belt 46 may be adjusted by any desired means but in the preferred embodiment is adjusted by resetting arm 64 mounted rollers 62, maintained in position by set screws 66. A slip plate 68 which may comprise, for example, polytetrafluoroethylene, and which is better seen with reference to FIG. 3 is pressed against filled-in C-shaped side 50 by a pressure mechanism such as a spring 70 on a shaft 72 which is adjustable for compression by a knurled knob 74 screw threaded onto shaft 72. Shaft 72 is rigidly fixed to leg 42 by threads in leg 42 and lock nut 75.

Core support 18 comprises an inverted L-shaped upright 76, a core support base 78 and a rotatable turntable 80 atop base 78. Table 80 is rotated by a screw thread 82 which acts in a worm drive fashion on teeth 84 on turntable 80 to position the table 80 in any desired position within a selected range. A handle or knob 86 is mounted on threaded screw 82 to provide a grip for hand turning the table 80. Affixed to table 80 is a magnetic chuck 87, such as model MB-60 manufactured by Jodon Engineering Associate, Inc., of Ann Arbor, Mich. Table 80 pivots about a machine 83 screw threaded into base 78.

Figure 2:
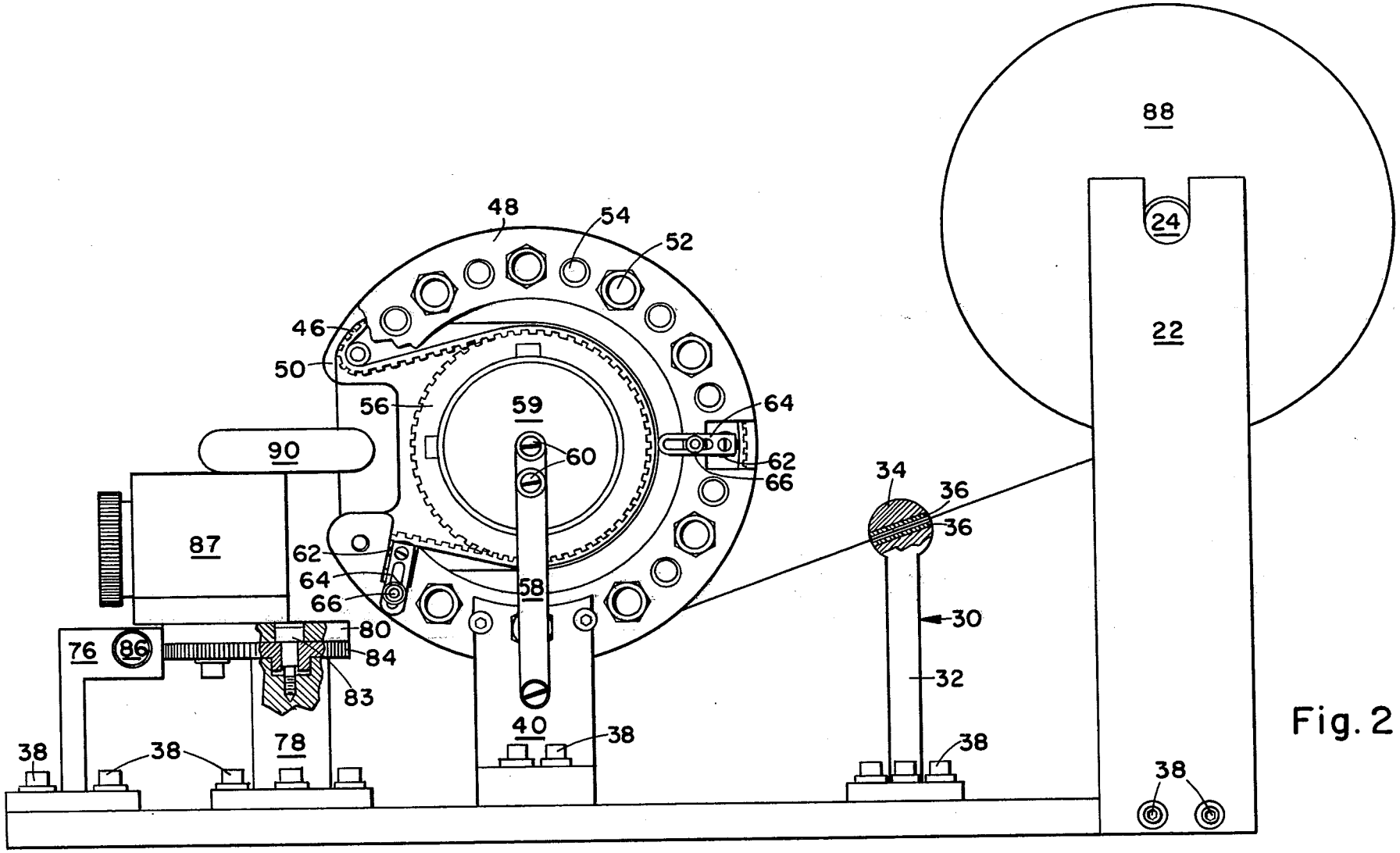
FIG. 2 is a partially cutaway side view of the FIG. 1 embodiment.

In operation, as seen in FIGS. 2 and 3, a spool of wire 88 is mounted on axle 24 so as to be rotatable. A wire lead from the spool 88 passes through bearing 36 in the head 34 of wire guide 30. The wire is then wound about the outer periphery of the belt 46 and through an orifice in a core 90 positioned on magnetic chuck 87 on table 80. The end of the wire is then tied to the wire itself to form a single loop about belt 46. Then, a length of wire sufficiently long to form as many loops as are desired to be wound around the core is unwrapped from spool 88 onto belt 46. The wire is repeatedly passed through the core by cranking handle 58 which pulls the wire from spool 88, through bearing 36 and the orifice of core 90, until the desired amount of wire is wound through the orifice in core 90 and about the outer periphery of belt 46. The wire between wire guide 30 and winder 16 is now cut and the end of the wire is then temporarily affixed to the core, or to, for example, the wing nut on chuck 87 seen in FIG. 3. Belt 46 is now turned in the same direction as it was to place the wire onto belt loop 46 and through the core 90 but the last supply turn of wire disposed on the belt is derailed therefrom and passed between filled-in C-shaped side 50 and polytetrafluoroethylene slip plate 68 tensioned against side 50 by spring 70. It will be noted that loops can successively be slipped completely off the winder 16 because shaft 72 does not pass between slip plate 68 and side 50 of the C-shaped structure. As handle 58 is continuously turned no slack appears in the wire due to the friction exerted between side 50 and plate 68 on the wire therebetween. In this manner every loop of wire can be wrapped on core 90 in a highly controllable fashion and at selected spacing and wire tension. As the core is wound the table 80 may be rotated as desired by turning knob 86 which, in worm drive fashion by threaded screw 82, rotates table 80.

The various features and advantages of the invention are thought to be clear from the foregoing description. However, various other features and advantages not specifically enumerated will undoubtedly occur to those versed in the art, as likewise will many variations and modifications of the embodiments illustrated herein, all of which may be achieved without departing from the spirit and scope of the invention as defined by the appended claims.

What is claimed is:

1. An apparatus for placing wire windings on a toroidal body having an orifice comprising: means for storing a supply of wire; means for supporting said body; an endless flexible belt forming a C-shaped loop with two spaced apart end portions and an inner and outer periphery and being adapted to receive wire loops encircling its outer periphery and bridging the space between said spaced apart end portions and located intermediate said storing and supporting means with said end portions disposed adjacent said supporting means and for positioning and moving said loops of wire through the orifice of said toroidal body; means for supporting and rotating said belt to wind said wire longitudinally along said outer peripheral portion; and means including a slip plate pressed against a side of said belt supporting said rotating means for slipping loops of said wire between said slip plate and said side from the outer peripheral portion of said belt onto said body.

2. The invention of claim 1 wherein said wire loops encircle said C-shaped belt loop and pass through the orifice of said toroidal body supported between said two end portions of said C-shaped belt loop.

3. The invention of claim 2 wherein said belt supporting and rotating means comprises means frictionally engaging said inner periphery of said belt loop for driving said belt.

4. The invention of claim 3 further comprising means for rotating said toroidal body between said end portions of said belt loop as wire is wound thereon.

5. The invention of claim 1 wherein said slipping means comprises two flat frictionally engaged discs between which wire is passed from said belt as said belt is rotated, said wire to be wrapped on said toroidal body.

* * * * *